US006945180B1

(12) United States Patent
Khymych

(10) Patent No.: US 6,945,180 B1
(45) Date of Patent: Sep. 20, 2005

(54) MINIATURE GARBAGE INCINERATOR AND METHOD FOR INCINERATION

(76) Inventor: Vasyl Khymych, 2402 63rd St., Apt. D2, Brooklyn, NY (US) 11204

( * ) Notice: Subject to any disclaimer, the term of this patent is extended or adjusted under 35 U.S.C. 154(b) by 0 days.

(21) Appl. No.: 10/858,811

(22) Filed: Jun. 3, 2004

(51) Int. Cl.[7] ..... F23G 5/10; F23C 9/00; F23J 15/00

(52) U.S. Cl. ..... 110/241; 110/250; 110/204; 110/203; 110/215; 110/216; 110/345

(58) Field of Search ..... 110/241, 240, 250, 110/203, 204, 205, 206, 207, 215, 216, 233, 110/346, 342, 344, 345, 224; 422/169

(56) References Cited

U.S. PATENT DOCUMENTS

| | | | | |
|---|---|---|---|---|
| 2,194,490 | A * | 3/1940 | Zimmerman | 110/233 |
| 3,029,754 | A * | 4/1962 | Doyle | 110/240 |
| 3,768,981 | A * | 10/1973 | Alliger | 422/171 |
| 4,627,365 | A | 12/1986 | Tseng | |
| 4,688,494 | A | 8/1987 | Domnitch | |
| 4,937,411 | A | 6/1990 | Suzuki | |
| 5,195,501 | A | 3/1993 | Ault | |
| 5,237,938 | A | 8/1993 | Fujimori | |
| 5,347,935 | A * | 9/1994 | Whitaker | 110/240 |
| 5,363,777 | A | 11/1994 | Yoshimoto | |
| 5,415,113 | A | 5/1995 | Wheeler | |
| 5,799,591 | A | 9/1998 | Anderson | |
| 6,105,515 | A | 8/2000 | Kaylor | |
| 6,325,000 | B1 | 12/2001 | Furuta | |
| 6,352,040 | B1 | 3/2002 | Voorhees | |
| 6,422,159 | B1 * | 7/2002 | Hunter | 110/214 |
| 6,425,335 | B1 | 7/2002 | Chen | |
| 6,474,249 | B1 | 11/2002 | Smith | |

* cited by examiner

*Primary Examiner*—Kenneth Rinehart
(74) *Attorney, Agent, or Firm*—Boris Leschinsky

(57) ABSTRACT

A portable miniature incinerator is described allowing easy disposal of household garbage for a single-family house or a small apartment building. The housing of the incinerator is mounted on a wheeled hand-truck assembly and contains an incineration block and a filtration block. The incineration block in turn comprises a furnace chamber equipped with an electric heater. The heater is adapted to bring the temperature of the air and therefore the temperature of the garbage up to the point of spontaneous combustion. During the process of heating up the garbage, it becomes dry as the fans of the device remove all water evaporation. Once ignited, the garbage is incinerated in the furnace chamber while all exhaust gases are directed to the filtration unit. The filtration unit has a first stage of filtration comprising a wire mesh separator submerged in water. Exhaust gases pass through the mesh separator and through the water so that the pollutants and exhaust particles are separated from the exhaust gases. Following that first filtration stage, the exhaust gases are sent toward the second cleaning stage, this stage being a fabric-filled gas filter, for complete separation of all impurities. The gases are then directed back towards the furnace chamber to re-circulate the flow of hot gases and save energy. That process continues until the incineration is complete.

12 Claims, 3 Drawing Sheets

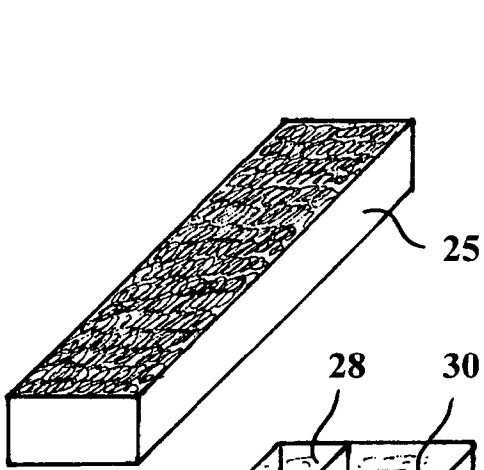
FIGURE 6
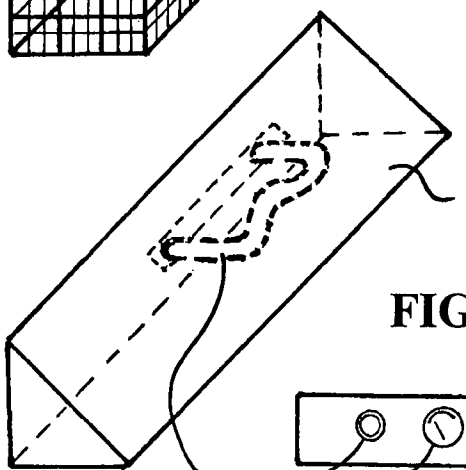
FIGURE 7
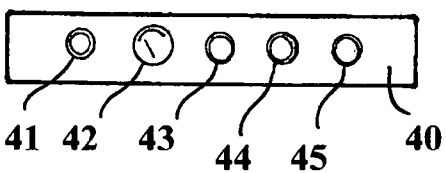
FIGURE 8
FIGURE 9
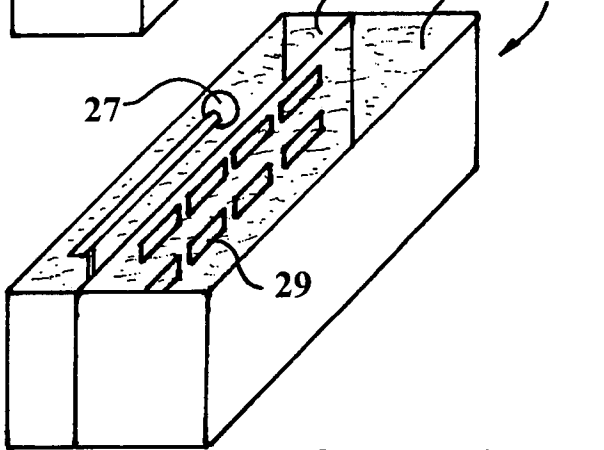
FIGURE 10

MINIATURE GARBAGE INCINERATOR AND METHOD FOR INCINERATION

BACKGROUND OF THE INVENTION

The present invention relates generally to an incineration method and a miniature garbage incinerator. The device of the invention contains provisions for electrical igniting of the garbage, its complete burning in the enclosed chamber and removal of harmful particulate from the exhaust gases before releasing them into atmosphere. The incinerator of the invention may be advantageously used for small waste incineration needs such as with single-family houses and small buildings. It can be easily transported from one site to the next.

Incineration has been determined to be the best way to deal with garbage. Many different types of waste incinerators and furnaces have been proposed in the past. For the most part, these are the large-scale industrial waste treating plants. Garbage is delivered to these sites for burning and further disposal. These devices require supply of fuel and exhaust treatment facilities to prevent polluting the atmosphere with escaping burning gases.

At the same time, there is a need for a small-scale household garbage incinerator so that garbage disposal can be done on site and less volume of trash is transported across the country. Small incinerators may find advantageous use for a single-family household, small apartment building or business complex and alike where they can be positioned in the basement provided environmental and safety concerns are adequately addressed. Small incinerators can be also easily transported from site to site allowing for their rental or otherwise combined use between several closely located sites.

Typically, garbage incinerators require a steady supply of liquid and solid fuel for their operation. For a miniature incinerator to be attractive for use in a single-family household, provisions are needed to eliminate to provide such fuel to the device. Otherwise, it will be of limited or no value due to the complexity of refueling such a device.

Various types of burners and incinerators have been provided to enable individual homeowners to burn trash or refuse. Individual homeowners frequently resort to open burning either on the ground or in a barrel-like container which creates a fire hazard due to flying sparks, hot ashes and the like. In addition, many jurisdictions have enacted legislation or ordinances prohibiting open burning of trash due to the fire hazard and discharge of pollutants into the atmosphere. The following U.S. patents relate to this field of endeavor: U.S. Pat. Nos. 1,871,614, 1,955,641, 1,970,727, 3,330,232, and 4,688,494. These patents disclose various types of burners, which basically include an enclosure to receive trash and enable combustion supporting air to enter the enclosure for the trash.

Several varieties of so-called cyclone furnaces and cyclonic incinerators are known, such as for burning fuels, supplying hot gaseous products of combustion for use in dehydration, some introducing waste tangentially through a tube or other suitable means into horizontally or vertically disposed chambers, For example, U.S. Pat. No. 2,707,444 to Van Loon discloses a cyclone furnace for burning fine-grained fuels that are entrained in a portion of the combustion medium, which is introduced tangentially into a refractory-material lined chamber. The remaining part of the medium is introduced tangentially into the chamber through a second inlet, and liquid slag is discharged through an outlet that is tangential to the interior chamber wall in a direction opposite to the direction of helical movement of fuel particles.

U.S. Pat. No. 3,179,150 to Arnold concerns a furnace for use in dehydration, in which combustion is completed within a refractory-lined combustion chamber so that no flame will be communicated through a flue. Within the chamber, vortex currents of secondary air are opposed to currents of primary air and to burning gases traversing the cylindrical chamber circumferentially in the opposite sense of rotation from the vortex currents of secondary air. When the opposing currents meet at substantial velocities, the impact of the gases upon each other promotes agitation with consequent intermixing so as to result in completion of combustion before the gases resume motion toward the flue.

In U.S. Pat. No. 3,865,054 to Monroe, Jr., a cyclonic incinerator having a start-up temperature of 1,600° F. to 3,000° F. is disclosed wherein the selected temperature is achieved through use of an auxiliary burner. Waste introduced tangentially through feeding means at one end of the chamber is caught up in the rapid cyclonic flow of hot gases in the chamber and is rapidly combusted. The waste can be propelled into the chamber by air or fuel, and rows of nozzles direct air tangentially into the combustion chamber wherein combustion preferably is started by an auxiliary burner axially positioned in one end of the chamber. U.S. Pat. No. 4,002,127 to Angus concerns a cyclone structure for use in controlling the flow of two fluid streams to create a localized inward radial flow and thus is remote from the purpose and features of the present invention.

U.S. Pat. No. 5,727,481 by Randall P. Voorhees et al. describes a portable armored incinerator for burning explosive material comprising a primary combustion chamber having armored walls and a loading cart mounted on telescoping rails, and a secondary combustion chamber mounted on a trailer. U.S. Pat. No. 5,799,591 by Berris M. Anderson describes an incinerator for burning medical waste in a self-contained unit comprising a hopper over a fire chamber connected to a scrubber tank supported on a wheeled conveyor mechanism which is connected to water and gas supply sources. The incinerator is distinguishable for its required scrubber apparatus based on a water supply.

U.S. Pat. No. 5,743,196 issued on Apr. 28, 1998, to Beryozkin et al. describes a mobile waste incinerator mounted on a truck having a connected receiving chamber, a preparation chamber, and an incineration chamber. The receiving chamber preheats the waste with recycled exhaust gases. The preparation chamber has small and large cutting blades for reducing the size of the waste. Each chamber is inclined up with the middle chamber being rotatable to 45 degree. The apparatus is distinguishable for its hopper system and rotating cutter blades.

U.S. Pat. No. 5,423,271 by Schulze describes a furnace employing incineration trays for burning away explosive substances. The apparatus is distinguishable for employing trailing incineration trays.

U.S. Pat. No. 5,881,654 by Fleming et al. describes a combustion apparatus for thermal treatment of energetic materials comprising a containment system, which maintains an interface between hot exhaust gas and a cooler gas. The apparatus is distinguishable for its reliance on an interface between hot and cool gases.

U.S. Pat. No. 3,938,450 by Jaronko et al. describes an apparatus having a wheeled chassis carrying a hopper, shredder and fan for directing air and refuse to a cylindrical member where the refuse is incinerated.

U.S. Pat. No. 4,627,365 by Tseng describes a mobile garbage incinerator with a hanging drum for lifting and dumping garbage into a collecting tank from which the garbage is removed to a main incinerating room, and then to a secondary incinerating room.

U.S. Pat. No. 5,237,938 by Fujimori et al. describes a medical refuse incinerating vehicle having a main furnace and an after-burning furnace with means for injecting lime water in the main furnace.

Finally, Canada Patent Application No. 2,037,621 published on Nov. 14, 1995, for Minoru Fujimori et al. describes a mobile incinerating vehicle for burning medical refuse having a rotary burner with a three-way valve in the main furnace in which air, oil or lime water is injected. An integral after-burning furnace communicates with the main furnace. The apparatus is distinguishable for its integrated structure lacking a particle separating connecting duct.

The above mentioned and other patents of the prior art do not address the need to provide a safe, small, portable and clean burning incinerator, which is easy to use by a non-trained person and can be used in every day life with high reliability and without a need for separate fuel supply.

SUMMARY OF THE INVENTION

Accordingly, it is an object of the present invention to overcome these and other drawbacks of the prior art by providing an incineration method and a novel portable incinerator for garbage disposal capable to being used by a common person without any special training.

It is another object of the present invention to provide a garbage incinerator not requiring separate fuel supply.

It is a further object of the present invention to provide a garbage incinerator with minimum or no pollution of the outside air.

It is yet a further object of the present invention to provide a garbage incinerator safe enough to be located in a basement of a house.

The device of the invention is small enough to be used both in a stationary mode as well as a mobile mode. It is best used to dispose of common household garbage such as kitchen trash and household trash of a single- or two-family house or a small apartment building. It can be conveniently located outside the house or in the basement. It does not require a separate fuel supply, just an electrical and water connection. It does not pollute the environment due to provisions described in detail below. The burning is complete within the enclosed chamber of the device and no portion of the after-burning materials and gases is allowed to escape outside the device. The device of the invention is reasonably energy efficient and is easy to use by a common person.

According to the invention, the device in mounted on a housing having a wheel support and a handle for easy transportation. It comprises two main sections—the incineration block and the filtration block. The incineration block in turn comprises a furnace chamber equipped with an electric heater. The heater is adapted to bring the temperature of the air and therefore the temperature of the garbage up to the point of spontaneous combustion. During the process of heating up the garbage, it becomes dry as the fans of the device remove all water evaporation. Once ignited, the garbage is incinerated in the furnace chamber while all exhaust gases are directed to the filtration unit.

The filtration unit has a first dual stage of filtration comprising a wire mesh separator submerged in water. Exhaust gases pass through the wire mesh separator and through the water so that the pollutants and exhaust particles are separated from the exhaust gases. Following that filtration stage, the exhaust gases are sent toward the second cleaning stage, this stage being a fabric-filled gas filter, for complete separation of all impurities. The gases are then directed back towards the furnace chamber to re-circulate the flow of hot gases and save energy. That process continues until the incineration is complete.

BRIEF DESCRIPTION OF THE DRAWINGS

A more complete appreciation of the subject matter of the present invention and the various advantages thereof can be realized by reference to the following detailed description in which reference is made to the accompanying drawings in which:

FIG. 6 is a view of a mesh separator of the exhaust-cleaning chamber of the device of the present invention, FIG. 7 shows a heating element in its enclosure, FIG. 8 is a general view of the control panel of the incinerator, FIG. 9 illustrates a fabric-filled gas separator of the exhaust-cleaning chamber of the incinerator, and finally FIG. 10 is view of the water compartment of the exhaust-cleaning chamber of the incinerator.

DETAILED DESCRIPTION OF THE PREFERRED EMBODIMENT OF THE INVENTION

A detailed description of the present invention follows with reference to accompanying drawings in which like elements are indicated by like reference letters and numerals.

Figure 2:
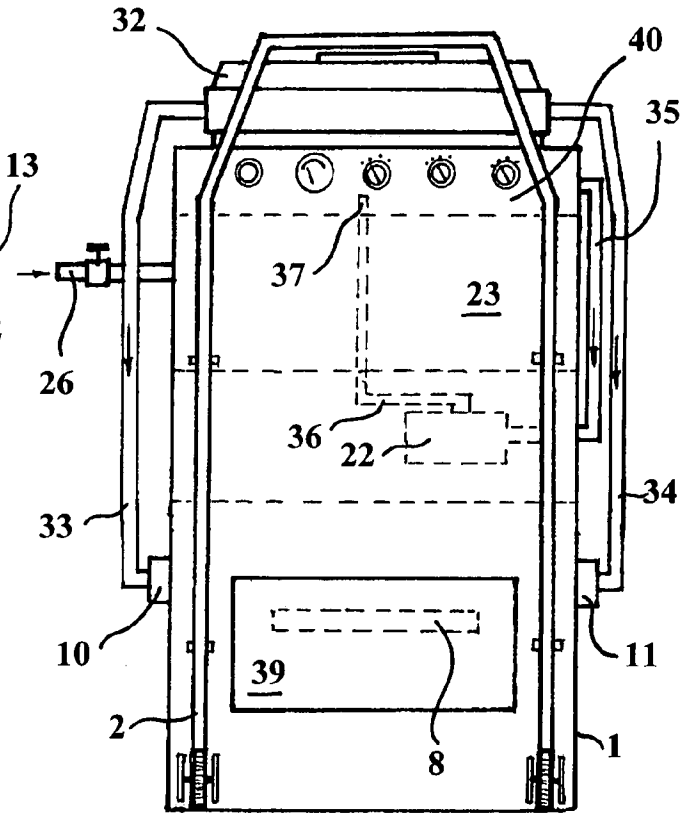
FIG. 2 is a general front view of the incinerator.
Figure 1:
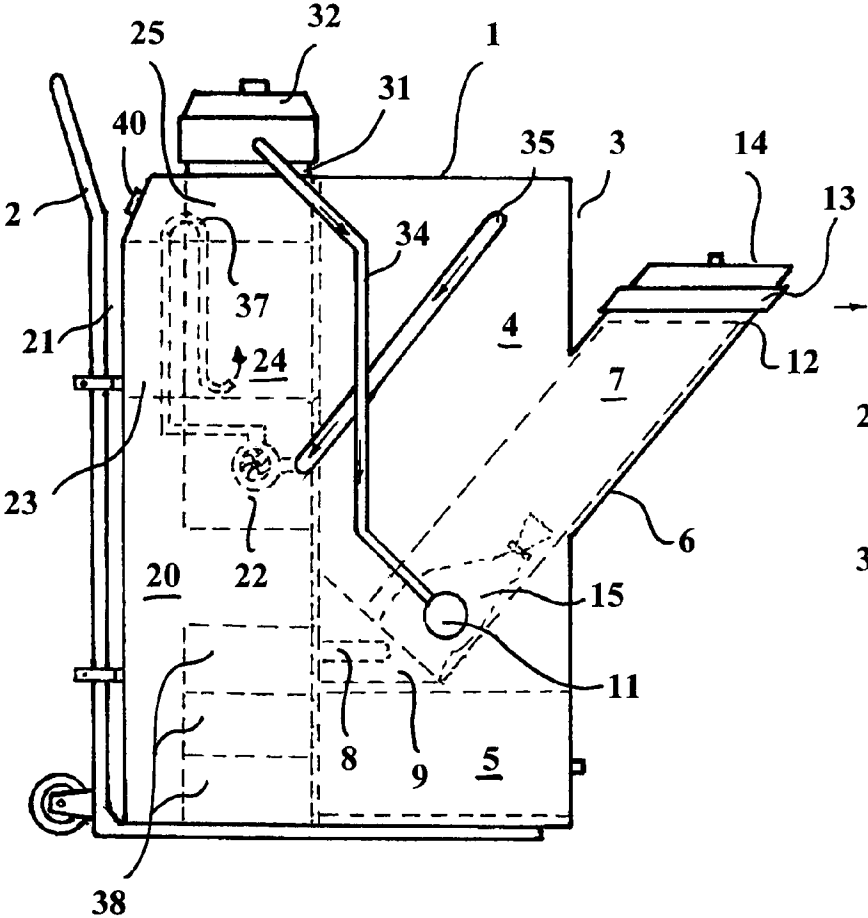
FIG. 1 is a general side view of the incinerator.
Figure 3:
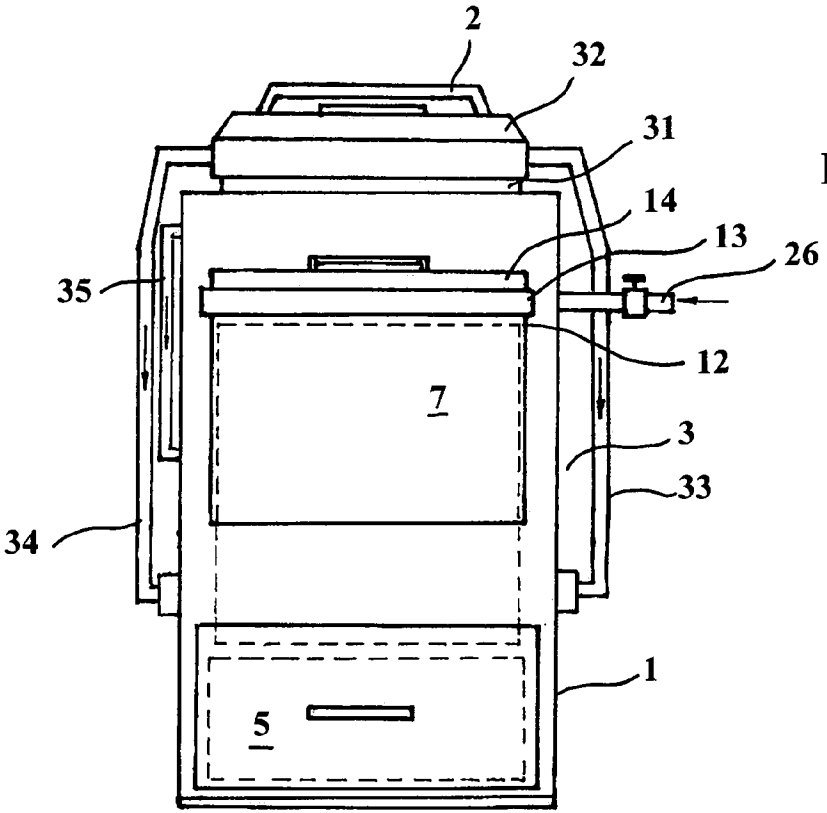
FIG. 3 is a general back view of the incinerator.

The miniature garbage incinerator of the present invention is shown in general on FIGS. 1, 2, and 3. It consists of a housing 1 mounted on a wheeled hand-truck assembly 2 so that it can be easily transported from place to place. The housing 1 contains both main components of the device: incineration block 3 and filtration block 20.

Incineration block 3 in turn is located in the back portion of the incinerator. It consists of a furnace chamber 4 and a retractable drawer 5 located underneath thereof for removal of the portion of the waste that could not be burned. The details of these elements can be best seen on FIGS. 1 and 2.

The furnace chamber 4 contains an inclined hopper 6 including a retractable extender 7, as well as a heating element 8 located inside its own enclosure 9 along with two fans 10 and 11 equipped with optional additional heating elements (not shown). Fans 10 and 11 are mounted on the housing 1 directly adjacent the lower portion of the retractable extender 7 placing them near the garbage bag 15. The extender 7 is slidably connected to the protrusion 12 of the housing 1 allowing it to be extended up or retracted back down to the vicinity of the furnace chamber 4.

Figure 4:
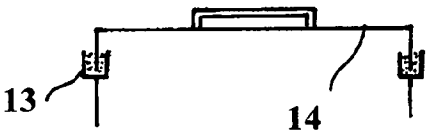
FIG. 4 is a cross-sectional view of the cover of the exhaust-cleaning chamber.

The hopper is made preferably rectangular or square in cross-section and is terminated on top with a flange 13 adapted to accept a cover 14. The flange 13 is made as a hollow channel so that its middle portion supports the cover 14. To prevent escape of the exhaust gases into atmosphere during the use of the incinerator of the present invention, the flange 13 is optionally filled with water (see FIG. 4) as will be explained in more detail below.

Figure 5:
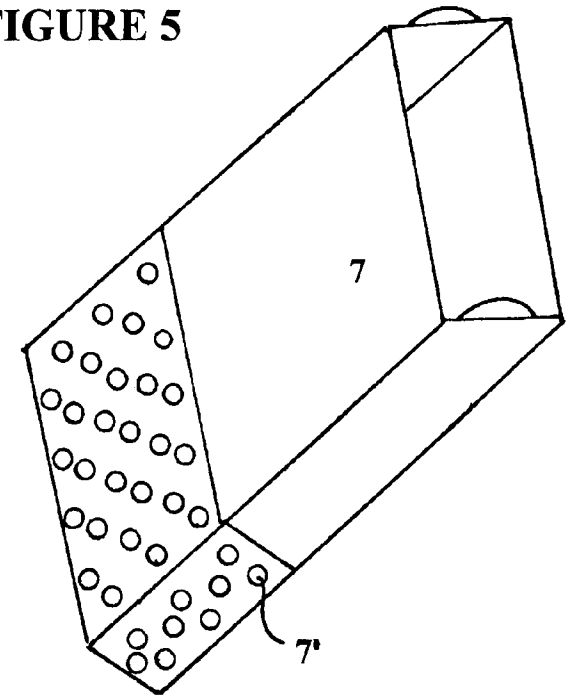
FIG. 5 is a view of the extending portion of the hopper of the incinerator.

The retractable extender 7 (see FIG. 5) has a rectangular shape and is open on the top. Its lower portion has perforations 7' located all around the sides and on the bottom thereof to allow free passage of air and gases in and out of the area containing the garbage bag 15. The extender is inclined at an angle of about 45 degrees. The garbage bag 15 is ordinarily placed through its top and allowed to slide to its bottom. Once the retractable extender 7 is filled with garbage, it is retracted back into its lower position and supported from the bottom by an edge of the enclosure 9 containing the heating element 8 as seen best on FIG. 7 and FIG. 1. The enclosure 9 has preferably a cross-sectional shape of an isosceles triangle, in which the diagonal side is open to allow air passage (such as with optional perforations or side opening, not shown on the drawings). The heating element 8 is located on the backside of the triangular enclosure 9 as shown to provide for hot air. In a preferred embodiment, the heating element 8 is an electrical coil but other well-known types of heating elements can also be used as can be appreciated by those skilled in the art, such as for example propane heaters, oil burning heaters and alike.

Filtration block 20 is located in the front part of the housing 1 and contains the exhaust-cleaning chamber 21 and a fan 22 as seen on FIGS. 1 and 2 in more detail. The exhaust-cleaning chamber 21 comprises in turn an assembled together water compartment 23 (see FIG. 10), a mesh separator 24 (see FIG. 6), and a fabric-filled gas filter 25 (see FIG. 9).

The water compartment 23 in turn has a water inlet pipe 26 to supply fresh water, as well as a floater assembly 27 separated by a divider 28 with a plurality of openings 29 from the inlet cavity 30, containing in turn the above mentioned mesh separator 24.

The wire mesh separator 24 is a 5-level mesh adapted to be entirely submerged in water of the water compartment. The separator is adapted to filter out large-size particles and debris. The floater assembly 27 maintains the water level at a predetermined desirable level. Contaminated water is discarded through the outlet opening (not shown) generally located at the bottom of the water compartment.

The fabric-filled gas filter 25 is located above the water compartment for the final filtration of the exhaust gases. Any appropriate gas filter may be used for the purpose of separating post-incineration particles from the exhaust gases. In a preferred embodiment, the gas filter cartridge contains an oil-impregnated fabric arranged in pleats to separate and retain even the smallest particles from the gases before they are allowed to be directed towards the outlet of the device.

The air chamber 31 is located above the gas filter 25 (see FIG. 4) and is covered by the air cover 32. The air chamber 31 is connected by the air pipes 33 and 34 with the fans 10 and 11 respectively.

The fan 22 is located vertically below the exhaust-cleaning chamber 21. Its inlet is connected by a pipe 35 with the upper portion of the furnace chamber 4, while its outlet is connected by a pipe 36 equipped with a bent water trap 37, which ends at the bottom of the wire mesh separator 24 of the exhaust-cleaning chamber 21. The height of the bend 37 is chosen to be equal to or just above the water level in the water compartment 23 to prevent water from entering the pipe 36. Spare filters 38 may be stored under the filtration block 20 and covered by a cover 39.

The control panel 40 is located on the front upper portion of the housing 1—see FIG. 2 and FIG. 8. The following units are located on the control panel 40, starting from the left side: push-button 41 to start the automatic mode of operation of the device; temperature gauge 42; heating element start and control button 43; fan start and control buttons 44 and 45. Buttons 43, 44, and 45 allow to both start the corresponding fans as well as to control their respective speeds in manual operation or allow the automatic speed control in the automatic mode of operation.

The incinerator of the invention works as follows. Following the loading of a commonly used garbage bag 15 filled with garbage into the hopper 6, it slides down to the bottom portion of the retractable extender 7 and stops against the diagonal surface of the enclosure 9 of the heating element 8. The start button 41 is depressed to cause the beginning of the automatic mode of operation of the device using the fans 22, heating element 8, as well as fans 10 and 11.

The heating element 8 is activated and increases the internal temperature of the air in the furnace chamber 4 to a predetermined high temperature level. The hot air passes through the perforations 7' and heats up the garbage bag 15. Even if wet articles are present in the garbage they are dried up by the circulating hot air. Fans 10 and 11 located about the lower part of the retractable extender 7 also provide for circulation of hot air around the garbage bag 15 to increase the intensity of heating up thereof.

The bag 15 is inflamed once the temperature of hot air is high enough to cause its spontaneous self-ignition. The smoke and other gases produced during the burning of the garbage bag 15 rise up to the upper portion of the furnace chamber 4 and are automatically evacuated through the pipe 35 into the exhaust-cleaning chamber 21 by the fan 22.

Upon activation of the fan 22, the water compartment 23 is automatically and quickly filled with water through the pipe 26 until a predetermined level of water is reached as determined by the floater assembly 27.

The fan 22 forces the exhaust gases through the pipe 36 around the bend 37 into the lower part of the exhaust-cleaning chamber 21, i.e. into the inlet water cavity 30. The smoke and large exhaust particles are largely separated on the mesh separator into the water of the cavity 30. The air continues to rise up through the water and then is directed towards the final gas filter 25. Fans 10 and 11 automatically extract the clean air from the air chamber 31 through the pipes 33 and 34 respectively. The fans 10 and 11 further direct the masses of hot clean air back towards the burning garbage bag 15 thus increasing the intensity of incineration and re-circulating the air flow.

The cycle is then repeated until the entire garbage bag 15 is incinerated under controlled conditions as directed by the automatic or manual modes of operation.

Following the completion of incineration of the garbage, the polluted water is drained from the water compartment 23 down to the sewage system and is replaced with the fresh water from the house water supply through the pipe 26.

Garbage remnants that could not be incinerated (such as metal parts, glass, etc.) are disposed of by pulling up slightly on the retractable extender 7 so that they are allowed to fall down into the metal drawer 5. The drawer is then open and these articles are then removed and disposed of in a usual way. It is expected of course that by far the most portion of the garbage is capable of being incinerated so that the volume of the remaining portion is reasonably small at the end.

According to the method of the invention, the following steps are undertaken to incinerate the garbage bag without the use of a dedicating ignition apparatus:

a. providing an electrical heater to bring the temperature of the garbage up to and keep it at or above the point of spontaneous combustion;
b. causing incineration of the garbage to begin in a furnace chamber once the temperature of spontaneous combustion is reached;
c. extracting the smoke and other exhaust gases and evaporation produced during the incineration of the garbage;
d. passing said exhaust gases and hot air through a wire mesh separator (preferably a multi-level wire mesh separator) adapted to separate large-size exhaust particles, said separator submerged in water;
e. passing said exhaust gases and hot air through water to clear up other pollutants from said gases and transfer them into said water;
f. passing the exhaust gases through an additional fabric-filled gas filter for final separation of all pollutants, said fabric being preferably an oil-impregnated fabric filling the canister of the filter;
g. re-circulating the exhaust gases by directing them back into the furnace chamber; and
h. repeating steps "c" through "g" until the incineration is complete.

The following are the main features and advantages of the incinerator and method of the present invention:

it provides for a small and mobile incinerator unit, which can be easily transported to the right place as well as moved from place to place;
it is low in weight and small in size;
it allows easy connection and disconnect from electrical and water supplies as well as sewage system;
it does not require a separate dedicated igniting device;
it is quite energy efficient due to re-circulating air flows inside the device;
it does not require supply of solid or liquid fuel for its operation;
it does not pollute the atmosphere by allowing the smoke to escape the device without thorough cleaning and filtering;
it allows for easy use in single-family households or small businesses and apartment complexes.

Although the invention herein has been described with respect to particular embodiments, it is understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A miniature portable garbage incinerator apparatus comprising:

an incineration block comprising a furnace chamber equipped with an electric heater and first fan means to circulate hot air and gases around the furnace chamber,
a filtration block comprising a wire mesh separator assembled together with a water compartment, said wire mesh separator positioned to be submerged in water when said water compartment is filled up to a predetermined level, said filtration block further including a fabric-filled gas filter and a second fan means to circulate hot air and gases therethrough and back into said furnace chamber,
a control panel, and
a wheeled hand-truck assembly supporting a housing containing said control panel, said incineration block and said filtration block.

2. The incinerator as in claim 1, wherein said furnace chamber is further equipped with a hopper.

3. The incinerator as in claim 2, wherein said hopper is further equipped with a retractable extender.

4. The incinerator as in claim 2, wherein said hopper is inclined at about 45 degrees.

5. The incinerator as in claim 1, wherein said electrical heater is further equipped with an enclosure to prevent it from direct contact with said garbage.

6. The incinerator as in claim 5, wherein said enclosure has a cross-sectional shape of a triangle, said enclosure adapted to have openings to allow free passage of hot air therethrough.

7. The incinerator as in claim 1, wherein said incineration block is further equipped with a retractable drawer located under said furnace chamber to allow removal of the portion of the garbage that can not be incinerated for further disposal.

8. The incinerator as in claim 1, wherein said filtration block is further equipped with means to supply and drain water.

9. The incinerator as in claim 8, wherein said means are automatic and responsive to a command from said control panel.

10. The incinerator as in claim 8, wherein said means further including a floater assembly to bring up and maintain the level of water in said water compartment to said predetermined level.

11. The incinerator as in claim 1, wherein said fabric of said fabric-filled gas filter is impregnated with oil and arranged in pleats.

12. A method for garbage incineration comprising the steps of:

a. providing an electrical heater to bring the temperature of the garbage up to and keep it at or above the point of spontaneous combustion;
b. causing incineration of the garbage to begin in a furnace chamber once the temperature of spontaneous combustion is reached;
c. extracting the smoke and other exhaust gases and evaporation produced during the incineration of the garbage;
d. passing said exhaust gases and hot air through a wire mesh separator adapted to separate large-size exhaust particles, said separator submerged in water;
e. passing said exhaust gases and hot air through water to clear up other pollutants from said gases and transfer them into said water;
f. passing the exhaust gases through an additional fabric-filled gas filter for final separation of all pollutants,
g. re-circulating the exhaust gases by directing them back into the furnace chamber; and
h. repeating steps "c" through "g" until the incineration is complete.

* * * * *